US008016272B2

(12) United States Patent
Tharp

(10) Patent No.: US 8,016,272 B2
(45) Date of Patent: Sep. 13, 2011

(54) RETRIEVABLE DIFFUSER MODULE WITH TRUSS CONSTRUCTION

(75) Inventor: Charles E. Tharp, Columbia, MO (US)

(73) Assignee: Environmental Dynamics, Inc., Columbia, MO (US)

( * ) Notice: Subject to any disclaimer, the term of this patent is extended or adjusted under 35 U.S.C. 154(b) by 942 days.

(21) Appl. No.: 11/873,245

(22) Filed: Oct. 16, 2007

(65) Prior Publication Data

US 2009/0096117 A1 Apr. 16, 2009

(51) Int. Cl.
*B01F 3/04* (2006.01)

(52) U.S. Cl. ..... 261/120; 261/122.1; 210/242.2

(58) Field of Classification Search ..... 261/120, 261/122.1, 122.2, 124; 210/242.2
See application file for complete search history.

(56) References Cited

U.S. PATENT DOCUMENTS

| | | | | |
|---|---|---|---|---|
| 2,650,810 | A | 9/1953 | Nordell | |
| 2,989,186 | A | 6/1961 | Weis | |
| 3,160,685 | A | 12/1964 | Chase | |
| 3,174,733 | A | 3/1965 | Chase | |
| 4,012,470 | A * | 3/1977 | Thayer | 261/122.1 |
| 4,273,732 | A | 6/1981 | Roediger | |
| 4,563,277 | A | 1/1986 | Tharp | |
| 4,797,212 | A | 1/1989 | von Nordenskjold | |
| 5,290,487 | A | 3/1994 | Ludwig | |
| 5,330,688 | A * | 7/1994 | Downs | 261/122.2 |
| 5,587,114 | A | 12/1996 | Tharp | |
| 5,800,705 | A | 9/1998 | Downs | |
| 5,846,412 | A | 12/1998 | Tharp | |
| 5,906,774 | A * | 5/1999 | Loy | 261/120 |
| 5,945,040 | A | 8/1999 | Brauch et al. | |
| 6,086,056 | A * | 7/2000 | Leask et al. | 261/120 |
| 6,086,058 | A * | 7/2000 | Brauch et al. | 261/122.1 |
| 6,514,886 | B1 | 2/2003 | Theoret et al. | |
| 7,267,766 | B2 * | 9/2007 | Campion et al. | 210/221.2 |
| 2004/0201115 | A1 | 10/2004 | Sebastiani et al. | |
| 2005/0087894 | A1 * | 4/2005 | Campion et al. | 261/120 |
| 2007/0120276 | A1 | 5/2007 | Lechner et al. | |

FOREIGN PATENT DOCUMENTS

| | | |
|---|---|---|
| CA | 2313135 | 12/2001 |

* cited by examiner

*Primary Examiner* — Scott Bushey
(74) *Attorney, Agent, or Firm* — Husch Blackwell LLP

(57) ABSTRACT

A diffuser module and system for diffusing gas into liquid such as in aeration/mixing of wastewater. Each module has a header pipe and diffusers which receive gas from the header pipe. Each header pipe is equipped with a truss for enhanced structural strength and resistance to bending. The truss may take the form of a buoyancy/ballast pipe connected with the header pipe by purlins.

11 Claims, 2 Drawing Sheets

RETRIEVABLE DIFFUSER MODULE WITH TRUSS CONSTRUCTION

CROSS-REFERENCE TO RELATED APPLICATIONS

None.

FIELD OF THE INVENTION

This invention relates generally to the application of gas to liquid and deals more particularly with a gas diffuser module constructed in a truss configuration for enhanced structural characteristics.

BACKGROUND OF THE INVENTION

Applications involving the diffusion of gas into liquid include the aeration/mixing of water and wastewater in basins, lagoons, ponds and other containment structures. In the aeration/mixing of wastewater, multiple diffuser modules have been used with considerable success. A typical system includes floating or submerged air laterals which receive air from a blower or fan and apply the air through flexible air lines extending to submerged diffuser modules which may be arranged in a grid or other configuration. The diffuser modules may be of various types, one of which is a construction having a header pipe supporting elongated diffuser pipes that extend from its opposite sides. The diffusers may be flexible membrane tube diffusers having flexible membranes sleeved over the diffuser pipes, flexible membrane disk diffusers mounted on the diffuser pipes, or any other suitable type of diffuser. The modules may be arranged in a grid pattern throughout the basin to provide thorough and uniform mixing/aeration of the waste water.

Although systems using diffuser modules of this type have been successful, they are not wholly without problems. Maintenance and repair of the diffusers can be particularly difficult because of their submerged location. The diffusers must either be maintained or repaired in place, or, more commonly, the entire module containing one or more worn or defective diffusers must be lifted to the surface using a large crane or other heavy equipment. In large installations, it may be difficult if not impossible for a crane to reach units in the center or near a remote side or end of the basin, even if the crane is equipped with a lengthy boom. The need for heavy ballast to hold the modules down in normal operation adds to the difficulty involved in raising and maintaining the modules.

After maintenance and repair operations have been completed, the module must be replaced in the basins, again requiring the use of a crane or other heavy equipment and again complicated by the heavy ballast. Replacing the module involves the risk of damage, particularly if the module is tilted appreciably or is otherwise handled improperly as it is being lowered in the basin. If one or more of the diffusers are damaged during replacement, additional repair work is necessary and additional downtime of the entire system may result.

Handling the modules in this fashion exerts considerable stress on the piping. Consequently, the module size has been restricted due to structural considerations. Even then, the piping can be easily broken or otherwise damaged during maintenance operations.

SUMMARY OF THE INVENTION

In accordance with the invention, a diffuser module is constructed in the form of a truss which substantially enhances its structural strength and rigidity. Consequently, the module can be handled during maintenance operations without breaking or otherwise being damaged. Equally important, the enhanced structural strength allows the module to be constructed in a manner to provide more diffusers and thus more aeration/mixing capability with resulting efficiencies and economies.

The truss may include a header pipe which supplies gas to diffusers and a truss pipe connected to the header pipe by purlins. In one embodiment, the truss pipe may be open at its opposite ends to allow liquid to enter when the module is submerged, thereby providing ballast. The truss pipe may also serve as a buoyancy device in one embodiment of the invention. A gas line may supply gas to the truss pipe to make the diffuser module buoyant so that it can be retrieved to the surface for maintenance work.

The diffuser modules may be suspended from floating air laterals or may be floor mounted units. The air supply may be provided from virtually any convenient location. Various types of diffusers may be used on the module. Of particular benefit when the chamber in the truss pipe is used as a ballast chamber is the ability to minimize the need for additional ballast. This facilitates retrieval of the diffuser modules as well as handling and placement of the modules back in the basin or lagoon. Also, because the header pipe is not supplied with heavy ballast, the pipes can be constructed of plastic rather than metal, and advantage is taken of the benefits of plastic, including reduced cost.

BRIEF DESCRIPTION OF THE SEVERAL VIEWS OF THE DRAWING

In the accompanying drawings, which form a part of the specification and are to be read in conjunction therewith and in which like reference numerals are used to indicate like or similar parts in the various views.

DETAILED DESCRIPTION OF THE INVENTION

Figure 1:
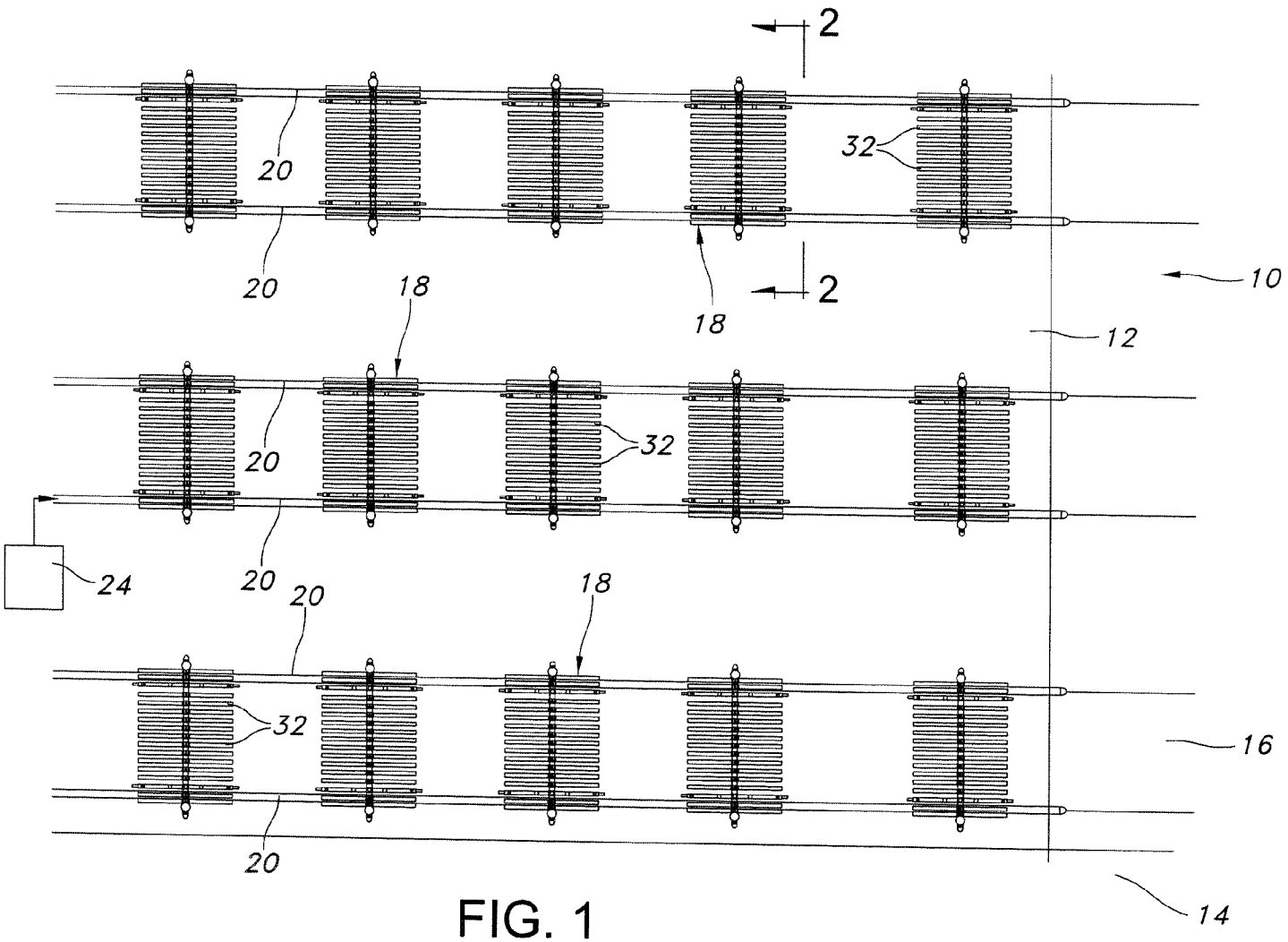
FIG. 1 is a top plan view diagrammatically illustrating a wastewater aeration/mixing system equipped with a plurality of retrievable diffuser modules constructed according to one embodiment of the present invention.

Referring now to the drawings in more detail and initially to FIG. 1, the present invention is directed to the application of gas to a liquid which may take the form of an aeration/mixing system generally identified by numeral 10 in FIG. 1. The system 10 may be used for the aeration/mixing of wastewater contained in a basin having a floor 12 bounded by sloping opposite sidewalls 14 and sloping opposite end walls 16. Alternatively, the system 10 can be used in basins, tanks, lagoons, ponds or other containers having virtually any size and configuration.

The system 10 includes a plurality of diffuser modules generally identified by numeral 18. The diffuser modules 18 may be supplied with air from a plurality of floating supply pipes or air laterals 20 which may be plastic pipes floating on the surface of the wastewater (see FIG. 1). Air is supplied to the floating air laterals 20 by a blower 24 (FIG. 1) or other suitable source of air. Flexible air hoses 26 (FIG. 2) are connected at their upper ends with the air laterals 20 and at their lower ends with the diffuser modules 18 in order to deliver air from the air laterals 20 to the diffuser modules 18. A variety of other air supply arrangements can be employed, including a header pipe on a wall of a basin connected to flexible hoses feeding air to the diffuser modules 18.

Figure 2:
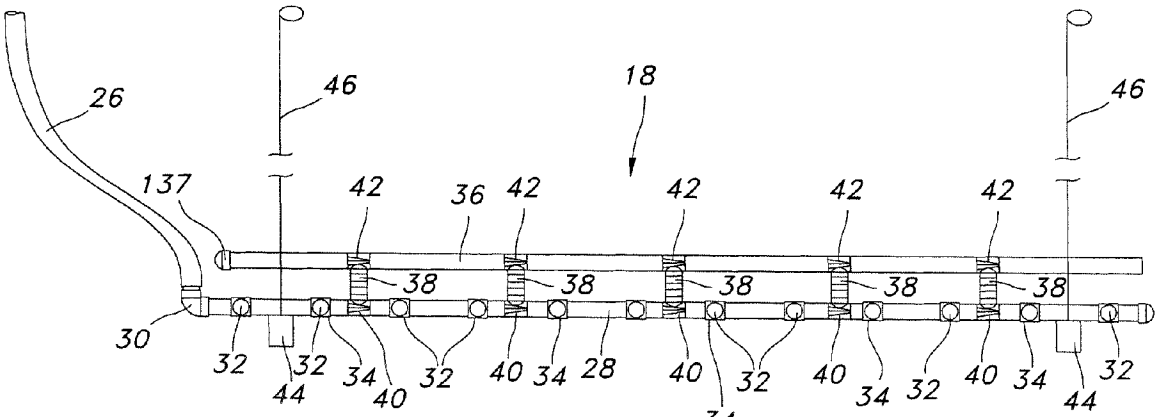
FIG. 2 is a diagrammatic side elevational view of a diffuser module constructed according to an embodiment of the invention taken generally along line 2-2 of FIG. 1 in the direction of the arrows.

One construction of the diffuser modules 18 is shown in FIG. 2. Each module 18 has a frame which includes a central header pipe 28 extending the length of the module 18 along its longitudinal axis. The pipe 28 may be constructed of any suitable material, including stainless steel, plastic or the various other types of materials used in such applications. Plastic is preferred, principally for cost reasons and because the module construction does not require the strength of metal. At one end of each header pipe 28, an elbow fitting 30 provides a connection between the lower end of the flexible air hose 26 and the header pipe 28. In this manner, air is supplied through the hoses 26 to the header pipe 28 and along the length of each header pipe. Air can be supplied to pipe 28 at one or more other or additional locations and/or in another way. A plurality of diffuser pipes 32 extend from the opposite side of the header pipe 28 and may be arranged in groups spaced apart along the length of the header pipe 28. The diffuser pipes 32 may be connected with the header pipe 28 by saddles 34 or in any other suitable manner. The saddles 34 provide entry points admitting air to the diffuser pipes 32 from the header pipes 28. The diffuser pipes 32 are preferably equal in length and are oriented horizontally when the aeration module 18 is submerged in the treatment basin in its operating position.

The diffuser pipes 32 may be equipped with conventional flexible membranes sleeved over the pipes in order to diffuse air into the wastewater from the pipes 32 in the form of fine bubbles for high efficiency aeration. Alternatively, disk diffusers (not shown) may be mounted along the length of each diffuser pipe 32 and equipped with disk membranes which apply the air through the membranes in the form of fine bubbles. Other types of diffusers may be used as well.

A ballast chamber is formed within a pipe 36 which may be substantially parallel to pipe 28. Pipe 36 is shown as being a short distance above pipe 28, but it can also be located below pipe 28. Pipe 36 can be of any desired size and length as necessary for the particular application of the diffuser module. A plurality of short pipes 38 form purlins extending rigidly between pipes 28 and 36 to form a truss structure. Mounting saddles 40 are secured to pipe 28 to connect pipes 38 to pipe 28 at one end, and additional saddles 42 are secured to pipe 36 to connect the opposite ends of pipes 38 to pipe 36.

Pipes 28 are equipped with ballast which may take the form of ballast blocks 44 suitably secured to pipes 28. Cables or ropes 46 are secured to pipes 28 to allow the diffuser modules 18 to be lifted to the surface for maintenance work including repair of the diffuser membranes and/or replacement of diffusers. The upper ends of the ropes 46 may be connected with floats (not shown) or tied to the floating air laterals 20 for convenient access.

Pipe 36 serves as a beam and is part of the truss structure which also includes pipe 28 and purlins 38. With heavy ballast such as ballast blocks 44 applied to pipe 28, a substantial structural load is encountered that can result in undue bending and even breaking of pipe 28 when it is a stand-alone unit. The truss construction enhances the structural strength considerably and resists bending of the piping during lift out and other situations where the module must be handled. Pipes 36 are filled with liquid when modules 18 are submerged, and the insides of pipes 36 thus provide ballast chambers which reduce the need for other ballast. The external ballast chambers provided by pipes 36 are beneficial in this respect and are also a significant structural benefit due to the strength of the truss structure of which they are a part.

Figure 3:
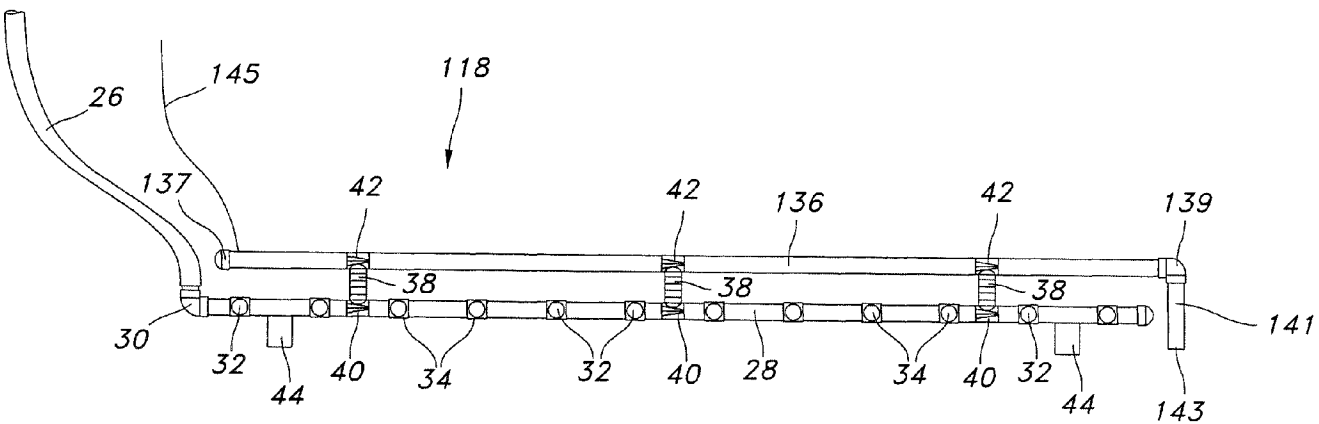
FIG. 3 is a diagrammatic side elevational view of a diffuser module constructed according to another embodiment of the invention.

FIG. 3 shows a modified embodiment in which each diffuser module 118 is constructed in the same manner as module 18 for the most part. However, the upper truss pipe 136 has a construction somewhat different from pipe 36. Pipe 136 is closed at one end by a cap 137 and equipped on its opposite end with a down-turned elbow 139 which connects with a vertical spout 141. The spout 141 has an open lower end providing a flow control opening 143 which functions as a hydraulic seal. Air may be supplied to and vented from pipe 136 through a hose 145. If pipe 136 is above pipe 28 as depicted, spout 141 can have a substantial length if necessary to perform its hydraulic seal function effectively.

In a case where pipe 136 acts as a buoyancy chamber, the inside of pipe 136 can be filled with air applied through hose 145 to purge water from pipe 136. The added buoyancy of pipe 136 is able to overcome the ballast 44 so that the diffuser module 118 can be raised to the surface buoyantly for service. Following completion of the maintenance work, air can be vented from pipe 136 so that it is then filled with water causing the diffuser module to sink to its submerged operating position. Pipe 136 serves as a beam and like pipe 36 is part of a truss structure which also includes pipe 28 and purlins 38. Also, it can be used as a ballast chamber or as a buoyancy chamber as indicated.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A diffuser module for applying gas to liquid, comprising:

a diffuser assembly including a header pipe and a plurality of diffusers connected with said header pipe to receive gas therefrom;

a gas supply line extending to said header pipe to supply gas thereto;

a beam member comprising a pipe providing a buoyancy chamber and including a buoyancy line connected with said buoyancy chamber for selectively supplying gas thereto for effecting a buoyant condition of said diffuser assembly, said pipe having opposite ends, and including a cap on one of said ends and a flow control opening on the other of said ends through which liquid enters and is discharged from said buoyancy chamber; and a plurality of rigid purlins interconnecting said header pipe and beam.

2. A diffuser module as set forth in claim 1, wherein said flow control opening is at an elevation lower than said buoyancy chamber.

3. A diffuser module as set forth in claim 1, wherein said beam member comprises a pipe having open opposite ends to allow liquid to fill said pipe when submerged.

4. A diffuser module for applying gas to liquid, comprising:

a diffuser assembly including a header pipe and a plurality of elongated diffusers connected to receive gas therefrom;

a gas supply line for supplying gas to said header pipe; and a truss connected with said header pipe for structural enhancement, said truss comprising:

a beam spaced from and substantially parallel to said header pipe, said beam comprising a pipe providing a buoyancy chamber and including a buoyancy line for applying gas to and exhausting gas from said buoyancy chamber; and a plurality of purlins interconnecting said beam and said header pipe.

5. A diffuser module as set forth in claim 4, wherein said pipe has opposite ends, and including a cap on one of said ends and a flow control opening on the other of said ends through which liquid enters and is discharged from said buoyancy chamber.

6. A diffuser module as set forth in claim 5, wherein said flow control opening is at an elevation lower than said buoyancy chamber.

7. A diffuser module as set forth in claim 4, wherein said beam comprises a pipe having open opposite ends to allow liquid to fill said pipe when submerged.

8. Apparatus for applying gas to a liquid, comprising:

a plurality of diffuser modules for immersion in the liquid, each module including a header pipe and a truss connected with said header pipe for structural enhancement thereof, said truss comprising:

a beam spaced from and substantially parallel to said header pipe, said beam comprising a pipe providing a buoyancy chamber and including a buoyancy line for applying gas to and exhausting gas from said buoyancy chamber; and a plurality of purlins interconnecting said beam and said header pipe;

a plurality of diffuser pipes extending from each of said header pipes to receive gas therefrom for discharge into the liquid; and a gas supply line extending to each header pipe to supply gas thereto.

9. A diffuser module as set forth in claim 8, wherein said pipe has opposite ends, and including a cap on one of said ends and a flow control opening on the other of said ends through which liquid enters and is discharged from said buoyancy chamber.

10. A diffuser module as set forth in claim 9, wherein said flow control opening is at an elevation lower than said buoyancy chamber.

11. A diffuser module as set forth in claim 8, wherein said beam comprises a pipe having open opposite ends to allow liquid to fill said pipe when submerged.

* * * * *